US011788284B1

(12) United States Patent
Parham

(10) Patent No.: US 11,788,284 B1
(45) Date of Patent: Oct. 17, 2023

(54) MODULAR RAFTER ASSEMBLY

(71) Applicant: Justin Parham, Linden, AL (US)

(72) Inventor: Justin Parham, Linden, AL (US)

( * ) Notice: Subject to any disclaimer, the term of this patent is extended or adjusted under 35 U.S.C. 154(b) by 39 days.

(21) Appl. No.: 17/735,240

(22) Filed: May 3, 2022

(51) Int. Cl.
*E04B 7/04* (2006.01)
*E04C 3/06* (2006.01)

(52) U.S. Cl.
CPC ..... *E04B 7/045* (2013.01); *E04C 3/06* (2013.01)

(58) Field of Classification Search
CPC ..... E04B 7/045; E04C 3/06; E04C 3/005
See application file for complete search history.

(56) References Cited

U.S. PATENT DOCUMENTS 3,196,994 A 7/1965 Piget
3,423,898 A 1/1969 Tracy et al.
3,596,941 A * 8/1971 Tracy ..... E04B 7/02 52/713
3,760,550 A * 9/1973 Mueller ..... E04B 1/34326 52/641
3,785,108 A * 1/1974 Satchell ..... E04C 3/11 52/645
5,983,577 A 11/1999 Hays
6,276,094 B1 * 8/2001 Hays ..... E04B 1/24 52/693
6,401,422 B1 * 6/2002 Olden ..... E04C 3/17 52/645
6,634,152 B1 * 10/2003 Pilkinton ..... E04C 3/07 52/645
6,681,538 B1 * 1/2004 Sarkisian ..... E04C 3/06 52/289
7,000,304 B2 * 2/2006 Sarkisian ..... E04B 1/2403 29/434
7,076,923 B2 * 7/2006 Seldon ..... E04D 13/0722 52/93.2
8,850,774 B2 * 10/2014 Kempf ..... E04B 1/2403 52/646
8,893,441 B1 * 11/2014 Hess, III ..... E04B 1/26 52/93.2
9,127,458 B2 * 9/2015 Donnelly ..... E04C 3/11
9,169,631 B2 10/2015 Tate
9,222,250 B2 12/2015 Peterson et al.
(Continued)

FOREIGN PATENT DOCUMENTS

EP 2378018 A2 * 10/2011 ..... E04B 1/2608
EP 3581726 A1 * 12/2019 ..... E04B 1/2608
KR 101761705 B1 * 7/2017

OTHER PUBLICATIONS

Search Report and Written Opinion for PCT/US2023/015346 (10 pages). (Year: 2023).*

(Continued)

*Primary Examiner* — Rodney Mintz
(74) *Attorney, Agent, or Firm* — Bradley Arant Boult Cummings LLP; Rudy Hill; Jessica L. Zurlo

(57) ABSTRACT

A modular rafter assembly is provided. The modular rafter assembly includes a plurality of different types of rafters having varying lengths and that are adjustable to varying pitches. The modular rafter assemblies disclosed herein utilize a plurality of rafters in varying lengths, widths, and using varying thickness plates to allow for differing load calculations. Each of the rafters also includes a pitch adjusting mechanism that allows adjustment of the pitch of the rafter depending on the desired roof pitch.

12 Claims, 15 Drawing Sheets

(56) References Cited

U.S. PATENT DOCUMENTS

| | | | | |
|---|---|---|---|---|
| 9,422,972 | B2 * | 8/2016 | Kempf | B66C 3/00 |
| 9,732,511 | B2 * | 8/2017 | Kempf | E04B 1/344 |
| 9,957,709 | B2 * | 5/2018 | Kempf | F16C 11/04 |
| 11,162,262 | B2 * | 11/2021 | Poutanen | E04C 3/16 |
| 2003/0041531 | A1 | 3/2003 | Seldon | |
| 2004/0010992 | A1 * | 1/2004 | Sarkisian | E04D 13/00 52/289 |
| 2004/0247378 | A1 * | 12/2004 | Sarkisian | E04D 13/00 403/83 |
| 2006/0283129 | A1 | 12/2006 | Salhaney | |
| 2007/0151200 | A1 * | 7/2007 | Madray | E04C 3/005 52/690 |
| 2010/0146900 | A1 | 6/2010 | Holland | |
| 2014/0260024 | A1 * | 9/2014 | Tate | E04C 3/40 52/693 |
| 2014/0260062 | A1 * | 9/2014 | Donnelly | E04C 3/11 52/646 |
| 2015/0121776 | A1 * | 5/2015 | Peterson | E04B 1/34331 52/79.5 |
| 2020/0102746 | A1 | 4/2020 | Poutanen | |

OTHER PUBLICATIONS

Korcz-Konkol, N. et al., "Stability of Roof Trusses Stiffened by Trapezoidal Sheeting and Purlins", MATEC Web of Conferences, Oct. 2018, vol. 219, pp. 1-7.

Mampel, S., et al., "Influence of Structural Detailing on the Stability Behaviour of Truss Girders", ce/papers, Sep. 2019, 3(3-4), pp. 847-852.

* cited by examiner

MODULAR RAFTER ASSEMBLY

TECHNICAL FIELD

The present invention relates generally to rafters, and more particularly, to a modular rafter assembly including a plurality of rafters having varying lengths and that are adjustable to varying pitches.

BACKGROUND

Rafters are sloped structural members, such as wooden or metal beams, that extend from the ridge of a roof to the wall plate, downslope perimeter, or eave, and that are designed to support the roof shingles, roof deck, and its associated load. Rafters currently on the market are generally prefabricated and are sold in standardized lengths and for a single roof pitch. When constructing new roof structures or adding lean-to type structures to existing or new construction, the pitch of the roof is often dictated by details of the main structure and conditions at the site, including, for example, the desired aesthetic, local building codes, or weather conditions. This makes it difficult to construct new roofs and lean-tos from standardized rafters that are designed for only one roof pitch. Thus, it often becomes necessary to manufacture and maintain an inventory of rafters for several different roof pitches, which is expensive and inconvenient. Moreover, it is only practical to maintain an inventory of rafters for a few standardized roof pitches.

Accordingly, there remains a need in the art for modular rafter assemblies that include rafters of varying lengths which can fit roofs of all sizes and that may be angularly adjusted to fit the pitch of roofs having different pitch angles.

SUMMARY

The problems expounded above, as well as others, are addressed by the following inventions, although it is to be understood that not every embodiment of the inventions described herein will address each of the problems described above. The present disclosure describes different embodiments of certain modular rafter assemblies.

In some embodiments, a modular rafter assembly having an adjustable pitch angle is provided, the modular rafter assembly including a pair of angularly disposed rafters, each rafter including a plurality of linear attachment holes, wherein the plurality of linear attachment holes each correspond to a different pitch angle, and wherein the pair of angularly disposed rafters are adjustably connected at an attachment hole to secure the rafters at a desired pitch angle. In some embodiments, the plurality of linear attachment holes comprises a first hole corresponding to a 4/12 pitch angle, a second hole corresponding to a 3/12 pitch angle, and a third hole corresponding to a 1/12 pitch angle. In further embodiments, each rafter includes a pivot hole for rotating the rafters to a desired attachment hole. In still further embodiments, each rafter comprises a top flange having a slot configured for attachment of a purlin clip. In yet further embodiments, each rafter includes four sections of linear attachment holes, each section including three linear attachment holes. In still further embodiments, the rafters are adjustably connected with a fastener selected from a bolt or screw.

In further embodiments, a modular rafter assembly having an adjustable pitch angle is provided, the modular rafter assembly including a first pair of angularly disposed rafters, each rafter including a plurality of linear attachment holes, wherein the plurality of linear attachment holes each correspond to a different pitch angle, and wherein the first pair of angularly disposed rafters are adjustably connected at an attachment hole to secure the rafters at a desired pitch angle, and a pair of eave rafters, each eave rafter operatively connected to one of the angularly disposed rafters, and wherein each eave rafter includes a base plate configured to adjust the eave rafter to the pitch angle of the angularly disposed rafters. In still further embodiments, the plurality of linear attachment holes includes four sections of three linear attachment holes. In yet further embodiments, the three linear attachment holes include an outermost hole corresponding to a 4/12 pitch angle, a middle hole corresponding to a 3/12 pitch angle, and an innermost hole corresponding to a 1/12 pitch angle. In still further embodiments, each base plate includes a side plate having a plurality of attachment holes for adjusting the eave rafter to the pitch angle of the angularly disposed rafters. In further embodiments, each base plate includes a front plate having an attachment hole for connecting a support member thereto. In yet further embodiments, each of the angularly disposed rafters and the eave rafters include a top flange having a slot configured for attachment of a purlin clip. In still further embodiments, each of the angularly disposed rafters and the eave rafters includes a top flange and a bottom flange forming two open sides. In further embodiments, the modular rafter assembly further includes a second pair of angularly disposed rafters operatively connected to the first pair of angularly disposed rafters and the eave rafters, wherein the second pair of angularly disposed rafters are shorter than the first pair of angularly disposed rafters.

In still further embodiments, a building structure is provided, the building structure including a pair of modular rafter assemblies, each modular rafter assembly including a pair of angularly disposed rafters, each rafter including a plurality of linear attachment holes, wherein the plurality of linear attachment holes each correspond to a different pitch angle, and wherein the pair of angularly disposed rafters are adjustably connected at an attachment hole to secure the rafters at a desired pitch angle, a pair of eave rafters, each eave rafter operatively connected to one of the angularly disposed rafters, and wherein each eave rafter comprises a base plate configured to adjust the eave rafter to the pitch angle of the angularly disposed rafters, a plurality of support members operatively attached to each eave rafter, and a plurality of purlin members attached to each modular rafter assembly and extending laterally therebetween. In some embodiments, the building structure may further include a plurality of purlin clips attached to each modular rafter assembly and configured for supporting the plurality of purlin members. In further embodiments, the plurality of linear attachment holes includes a first hole corresponding to a 4/12 pitch angle, a second hole corresponding to a 3/12 pitch angle, and a third hole corresponding to a 1/12 pitch angle. In still further embodiments, the building structure may further include an exterior sheathing mounted on the plurality of purlin members.

BRIEF DESCRIPTION OF THE DRAWINGS

Further features and advantages can be ascertained from the following detailed description that is provided in connection with the drawings described below.

DETAILED DESCRIPTION

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Numerical quantities given in this description are approximate unless stated otherwise, meaning that the term "about" or "approximately" can be inferred when not expressly stated.

The terminology used herein is for the purpose of describing particular embodiments only and is not intended to be limiting. As used herein, the singular forms "a", "an" and "the" are intended to include the plural (i.e., "at least one") forms as well, unless the context clearly indicates otherwise.

The terms "first," "second," "third," and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

Spatially relative terms, such as "above," "under," "below," "lower," "over," "upper," and the like, may be used herein for ease of description to describe one element or feature's relationship to another.

It is to be understood that any given elements of the disclosed embodiments of the invention may be embodied in a single structure, a single step, a single substance, or the like. Similarly, a given element of the disclosed embodiment may be embodied in multiple structures, steps, substances, or the like.

The present disclosure provides a modular rafter assembly that includes a plurality of different types of rafters having varying lengths and that are adjustable to varying pitches. Unlike pre-existing rafters that are typically fabricated in 20-foot or longer sections and designed for a specific pitch angle, the rafter assemblies disclosed herein offer a more modular design by providing a plurality of rafters in varying lengths, widths, and using varying thickness plates to allow for differing load calculations. Each of the rafters also includes a pitch adjusting mechanism that allows for the user to adjust the pitch of the rafter depending on the desired application.

Figure 1:
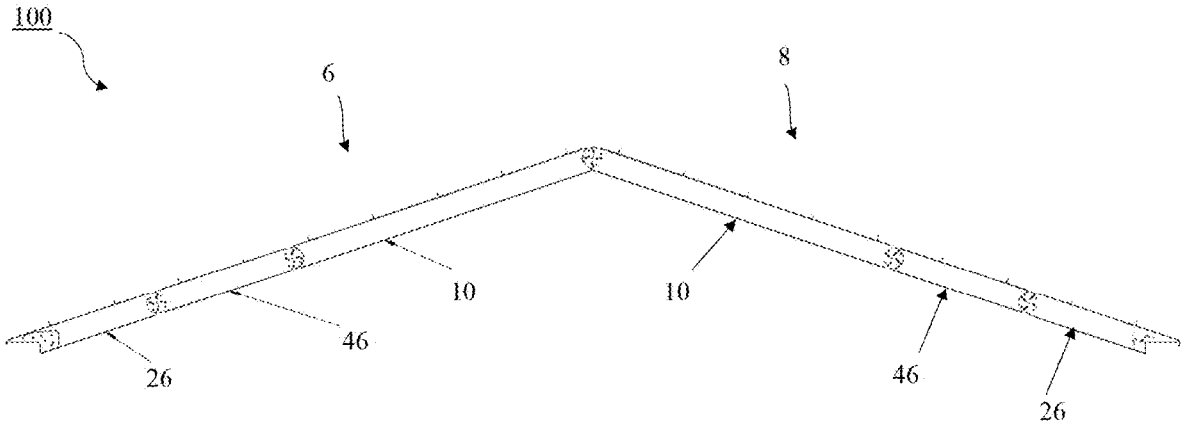
FIG. 1 is a side view of a modular rafter assembly according to an exemplary embodiment of the present disclosure.

Referring to FIG. 1, a modular rafter assembly 100 according to an exemplary embodiment of the present disclosure is shown. The modular rafter assembly 100 is composed of a plurality of interconnecting rafters of various lengths that can be used to frame roof structures of different types and sizes. As will be described in detail below, each of the rafters have a pitch adjusting mechanism that allows for the rafters to connect to one another at various pitch angles to match the desired pitch of the roof structure. In the illustrated embodiment, the modular rafter assembly 100 is formed of a first side 6 and a second side 8. Each of the first and second sides 6, 8 are composed of a plurality of interconnected rafters. As shown in FIG. 1, each side of the modular rafter assembly 100 is composed of a main rafter 10 connected to an extension rafter 46 and an eave rafter 26 connected to the extension rafter 46. The main rafter 10 on the first side 6 is joined to the opposing main rafter 10 on the second side 8 to form the modular rafter assembly 100. A plurality of the modular rafter assemblies 100 can be used to frame any type of roof of any size or dimensions.

Figure 2A:
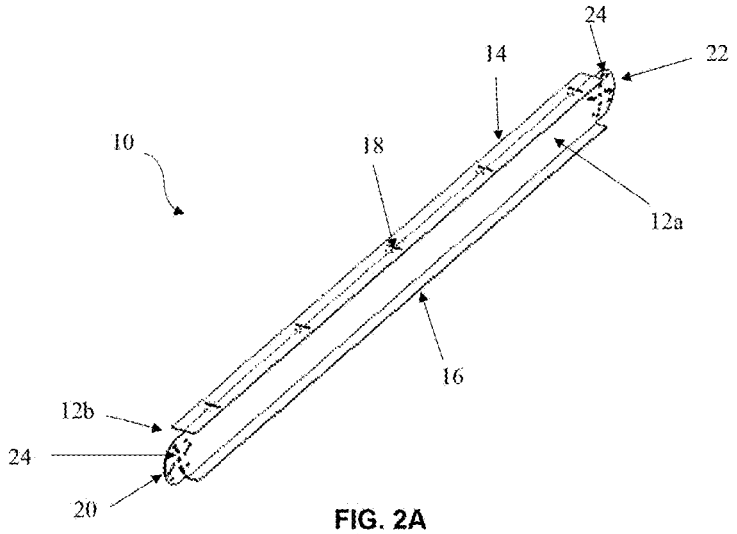
FIG. 2A is a front perspective view of a main rafter according to an exemplary embodiment of the present disclosure.
Figure 2B:
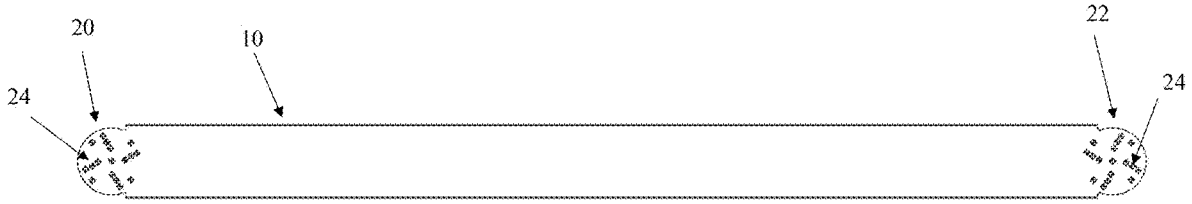
FIG. 2B is a side view of the main rafter shown in FIG. 2A.

FIGS. 2A-2B, 3A-3B, and 4 show the various rafters that may be used with the modular rafter assemblies 100 of the present disclosure. FIGS. 2A and 2B show the main rafter 10 according to one embodiment of the present disclosure. The main rafter 10 may be used to extend from the ridge of the roof to either an extension rafter 46 or an eave rafter 26. The main rafter 10 is generally rectangular in shape with two open sides 12*a*, 12*b* and circular ends 20, 22. The main rafter 10 has a top flange 14 and a bottom flange 16, both of which are generally flat. The top flange 14 and the bottom flange 16 define the open sides 12*a*, 12*b*, as shown in FIG. 2A. As will be described in more detail below, in some embodiments, the top flange 14 may include a plurality slots 18 for attaching purlin clips. The main rafter 10 has a first end 20 and a second end 22, each pre-punched or drilled with a series of attachment holes 24 for connecting the main rafter 10 to other rafters described herein and serving as a pitch adjustment mechanism for connecting the rafters at varying pitch levels.

The dimensions of the main rafter 10 can vary depending on the size of the roof to be framed. However, in some embodiments, the main rafter 10 has a length of about 8 feet to about 12 feet. In further embodiments, the main rafter 10 may have a length of about 8.5 feet to about 11.5 feet. In still further embodiments, the main rafter 10 may have a length of about 9 feet to about 10 feet. For example, the main rafter 10 may have a length of about 9 feet, 11 inches. In some embodiments, the main rafter 10 has a height of about 6 inches to about 10 inches. In further embodiments, the main rafter 10 may have a height of about 7 inches to about 9 inches. In still further embodiments, the main rafter 10 may have a height of about 8 inches.

Figure 3A:
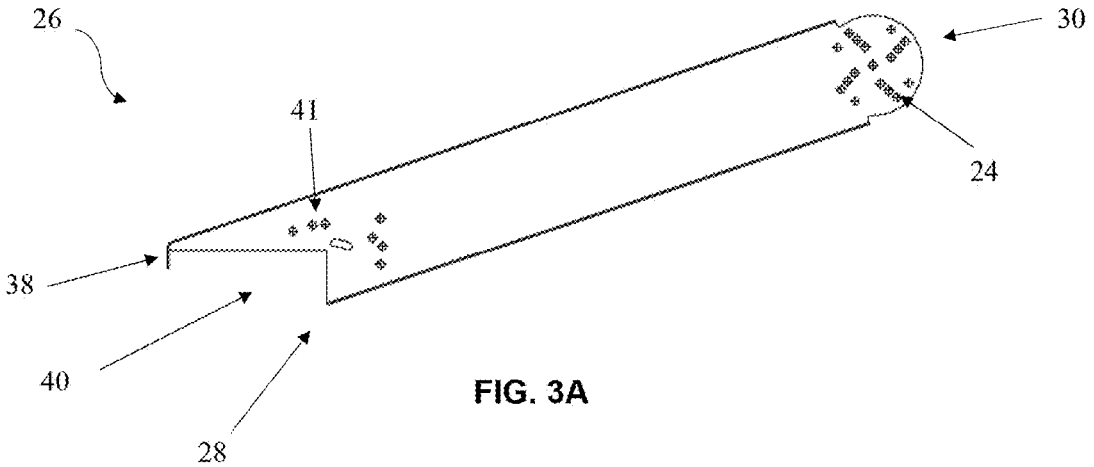
FIG. 3A is a side view of an eave rafter according to an exemplary embodiment of the present disclosure.
Figure 3B:
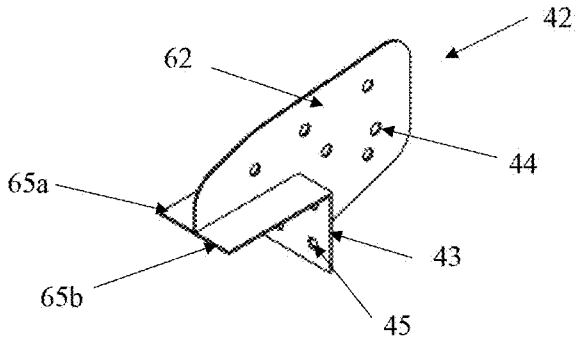
FIG. 3B is a perspective view of an eave base plate for use on the eave rafter according to one embodiment of the present disclosure.
Figure 3C:
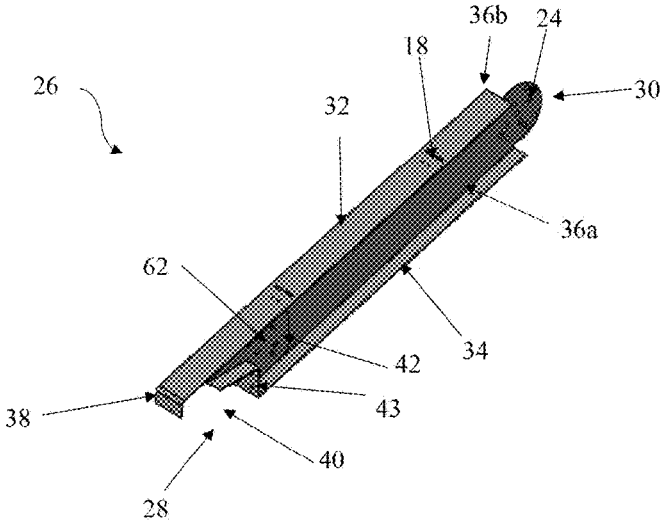
FIG. 3C is a front perspective view of the eave rafter shown in FIG. 3A.

FIGS. 3A, 3B, and 3C illustrate an eave rafter 26 according to one embodiment of the present disclosure. The eave rafter 26 is the structural component that may extend from the main rafter 10 or the extension rafter 46 to the eave of the roof. Like the main rafter 10, the eave rafter 26 is generally rectangular in shape. The eave rafter 26 has two mostly open sides 36*a*, 36*b* created by a top flange 32 and a bottom flange 34. The top flange 32 and the bottom flange 34 are both generally flat. The top flange 32 may include a plurality of slots 18 for attaching purlin clips.

As shown in FIG. 3A, the eave rafter 26 has a first end 28 configured for attachment to a structural element for supporting a building, such as a column, and a second end 30 configured for attachment to any of the rafters described herein. At the first end 28, the top flange 32 has a downwardly protruding edge 38 that extends past the bottom flange 34 to define a cutout portion 40. The cutout portion 40 defines the eave portion of the roof. The eave rafter 26 has a plurality of base plate attachment holes 41 positioned adjacent to the cutout portion 40 for attaching an eave base plate 42 (shown in FIGS. 3B and 3C). The base plate attachment holes 41 align with a plurality of corresponding attachment holes 44 on the eave base plate 42, which allows for adjustment of the pitch of the eave rafter 26 and attachment of the eave base plate 42 to the eave rafter 26 itself. The second end 30 is pre-punched or drilled with a series of the attachment holes 24 for connecting the eave rafter 26 to other rafters described herein at varying pitch levels.

FIGS. 3B and 3C illustrate the eave base plate 42 according to one embodiment of the present disclosure. As illustrated in FIG. 3B, the eave base plate 42 is comprised of a front plate 43 and a side plate 62 perpendicularly attached thereto. A pair of flanges 65*a*, 65*b* are formed substantially above the front plate 43 and in the middle of the side plate 62. As will be described in more detail below, the side plate 62 includes a plurality of attachment holes 44 for attaching the eave base plate 42 to the rafter itself (as illustrated in FIG. 3C) and for adjusting the pitch of the eave rafter 26 when it is connected to the other rafters described herein. The eave base plate 42 also includes a plurality of attachment holes 45 on the front plate 43 for connecting a structural element, such as a column, to the eave rafter 26. The eave base plate 42 may be attached to the eave rafter 26 using any type of fastener and may be positioned on the eave rafter 26 adjacent to the cutout portion 40.

Like the main rafter 10, the dimensions of the eave rafter 26 can vary depending on the size of the roof to be framed. However, in some embodiments, the eave rafter 26 has a length of about 3 feet to about 6 feet. In further embodiments, the eave rafter 26 may have a length of about 3.5 feet to about 5.5 feet. In still further embodiments, the eave rafter 26 may have a length of about 4 feet to about 5 feet. For example, the eave rafter 26 may have a length of about 4 feet, 11 inches. In some embodiments, the cutout portion 40 of the eave rafter 26 may have a length of about 9 inches to about 13 inches. In other embodiments, the cutout portion 40 may have a length of about 10 inches to about 12 inches. For instance, the cutout portion 40 may have a length of about 11.875 inches.

Figure 4:
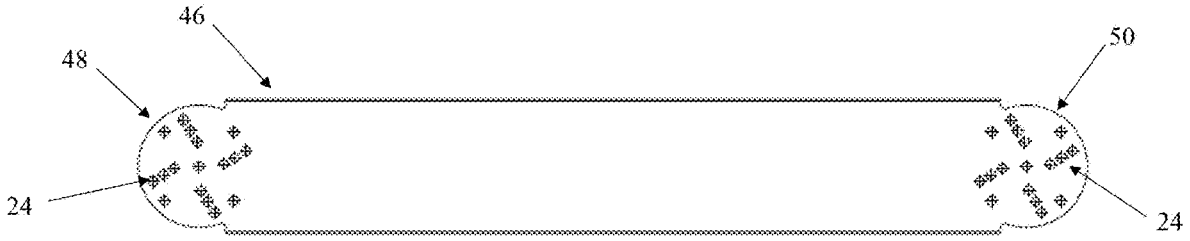
FIG. 4 is a side view of an extension rafter according to an exemplary embodiment of the present disclosure.

FIG. 4 shows an extension rafter 46. In some embodiments, the extension rafter 46 may be used in combination with both the main rafter 10 and the eave rafter 26 to elongate the modular rafter assembly 100 and accommodate roofs of a larger size. In other embodiments, the extension rafter 46 may be used in combination with only the eave rafter 26 to accommodate roofs of a smaller size. The extension rafter 46 is generally rectangular in shape with circular ends 48, 50. While not shown in FIG. 4, the extension rafter 46 has generally flat top and bottom flanges that define open sides like those illustrated on the main rafter 10 and the eave rafter 26. The top flange may include a plurality of slots (not shown) for attaching purlin clips. The extension rafter 46 has a first end 48 and a second end 50, each pre-punched or drilled with the series of attachment holes 24 for connecting the extension rafter 46 to other rafters described herein at varying pitch levels.

Similar to the main rafter 10 and the eave rafter 26, the dimensions of the extension rafter 46 can vary depending on the size of the roof to be framed. However, in some embodiments, the extension rafter 46 has a length of about 3 feet to about 6 feet. In further embodiments, the extension rafter 46 may have a length of about 3.5 feet to about 5.5 feet. In still further embodiments, the extension rafter 46 may have a length of about 4 feet to about 5 feet. For example, the extension rafter 46 may have a length of about 4 feet, 10 inches.

Figure 5:
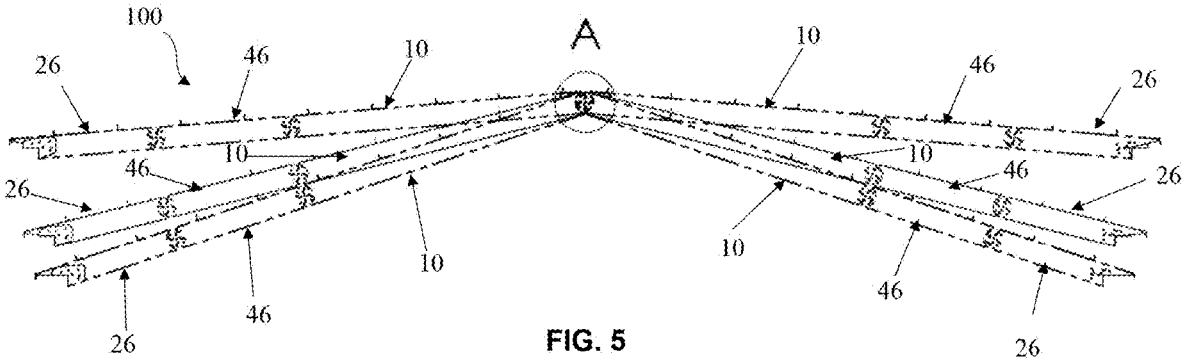
FIG. 5 is a side view of the modular rafter assembly showing various pitch angles according to one embodiment of the present disclosure.
Figure 6:
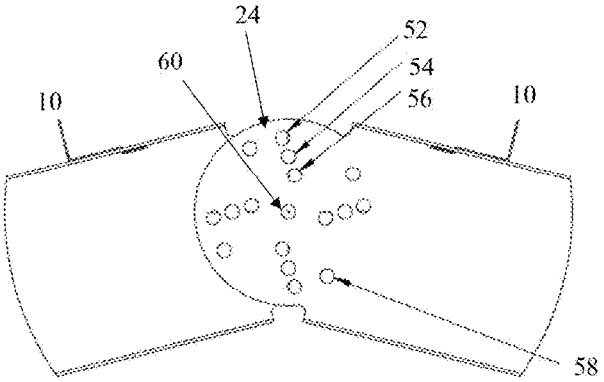
FIG. 6 is a front view of detail A shown in FIG. 5.

FIGS. 5 and 6 show a pitch adjusting mechanism that can be utilized with the modular rafter assembly 100 according to one embodiment of the present disclosure. As depicted in FIG. 5, the modular rafter assembly 100, including a plurality of interconnected main rafters 10, extension rafters 46, and eave rafters 26, can be angularly adjusted to fit the pitch of roofs having different pitch angles. This can be done without having to replace or find another set of rafters to match the pitch of the roof. The modular rafter assembly 100 can be adjusted to establish a shallow pitch roofline configuration, such as a 1/12 or 2/12 pitch (for example, about 4 to 10 degrees) or a steeper pitch roofline configuration, such as a 3/12 or 4/12 pitch (for example, about 14 to 19 degrees).

The pitch angle of the modular rafter assembly 100 can be adjusted using the series of attachment holes 24 on the ends of the main rafter 10, the extension rafter 46, and the eave rafter 26 described above. FIG. 6 illustrates the series of attachment holes 24 that can be used to adjust the angle of the interconnected rafters, such as the two main rafters 10 in the modular rafter assembly 100 shown in FIGS. 5 and 6. As shown in FIG. 6, the series of attachment holes 24 on the main rafter 10 includes four sections of three linear attachment holes. The linear attachment holes correspond to the varying pitch angles at which the rafters may be angularly connected. In the illustrated embodiment, the three linear attachment holes include an outermost hole 52 for connecting the rafters at an angle of about 18.43 degrees (or a 4/12 pitch), a middle hole 54 for connecting the rafters at an angle of about 14.04 degrees (or a 3/12 pitch), and an innermost hole 56 for connecting the rafters at an angle of about 4.76 degrees (or a 1/12 pitch). With the use of the linear holes, the rafters described herein can be angularly adjusted to match the desired pitch angle of the roof without having to prefabricate the rafters for a specific, individualized use. The linear holes also facilitate easy and efficient adjustments in pitch. While FIG. 6 illustrates three linear attachment holes, one of ordinary skill in the art will appreciate that any number of linear attachment holes may be used on the ends of the rafters to create steeper or shallower pitch connections than those depicted depending on the desired pitch of the roof.

As illustrated in FIG. 6, the series of attachment holes 24 may also include four straight attachment holes 58 positioned adjacent to each section of the three linear attachment holes. In some embodiments, the straight attachment holes 58 may be used to connect one rafter in the rafter assembly 100 to another rafter, for instance, each of the main rafters 10 to the extension rafter 46 or the eave rafter 26. In this embodiment, when one rafter is connected to another rafter in the rafter assembly 100 using the straight attachment holes 58, the modular rafter assembly 100 may have a continuous slope. For example, as depicted in FIG. 5, the two main rafters 10 may be connected to one another at one of the three linear attachment holes 52, 54, and 56 to create a 1/12, 3/12, or 4/12 pitch at the ridge of the roof, while the extension rafters 46 and the eave rafters 26 may be connected to one another at the straight attachment holes 58 to create a continuous slope from the ridge of the roof to the eave. The series of attachment holes 24 may also include a central pivot hole 60 about which the connected rafters may rotate to the desired pitch angle.

In other embodiments, the rafters may be connected to one another using one of the three linear attachment holes 52, 54, and 56 at connection points other than at the ridge of the roof. In this embodiment, the modular rafter assembly 100 may have varying slopes along each side thereof. For instance, the modular rafter assembly 100 may have two main rafters 10 connected to one another at one of the three linear attachment holes 52, 54, and 56 to create a 1/12, 3/12, or 4/12 pitch at the ridge of the roof and extension rafters 46 connected to the main rafters 10 at the innermost holes 56 to create a 1/12 pitch between the extension rafters 46 and the main rafters 10, while the eave rafters 26 may be connected to the extension rafters 46 at the middle holes 54 to create a 3/12 pitch between the extension rafters 46 and the eave rafters 26. This configuration creates a modular rafter assembly 100 having varying slopes along each side thereof.

In some embodiments, the pattern of the series of attachment holes 24, including the pattern of the linear outermost holes 52, middle holes 54, and innermost holes 56, is substantially the same on each of the ends of the main rafter 10, the extension rafter 46, and the second end 50 of the eave rafter 26 so that the attachment holes 24 align when one rafter is connected to another rafter. A fastener (not shown), such as a bolt or screw, may be placed through the outermost hole 52, the middle hole 54, or the innermost hole 56 on one rafter and a corresponding outermost hole 52, middle hole 54, or innermost hole 56 on another rafter to connect the rafters and secure the connected rafters at the desired pitch angle. For example, for a steep pitch configuration, a fastener can be placed through each of the outermost holes 52 in the series of attachment holes 24 to secure two rafters at an angle of about 18.43 degrees (or a 4/12 pitch). In other embodiments, for a less steep pitch configuration, a fastener can be placed through each of the middle holes 54 in the series of attachment holes 24 to secure two rafters at an angle of about 14.04 degrees (or a 3/12 pitch). In still other embodiments, for a shallow pitch configuration, a fastener can be placed through each of the innermost holes 56 in the series of attachment holes 24 to secure two rafters at an angle of about 4.76 degrees (or a 1/12 pitch). The fasteners fix the pitch of the rafters at a selected and predetermined height and angle and prevent any change of pitch while in use.

Figure 7:
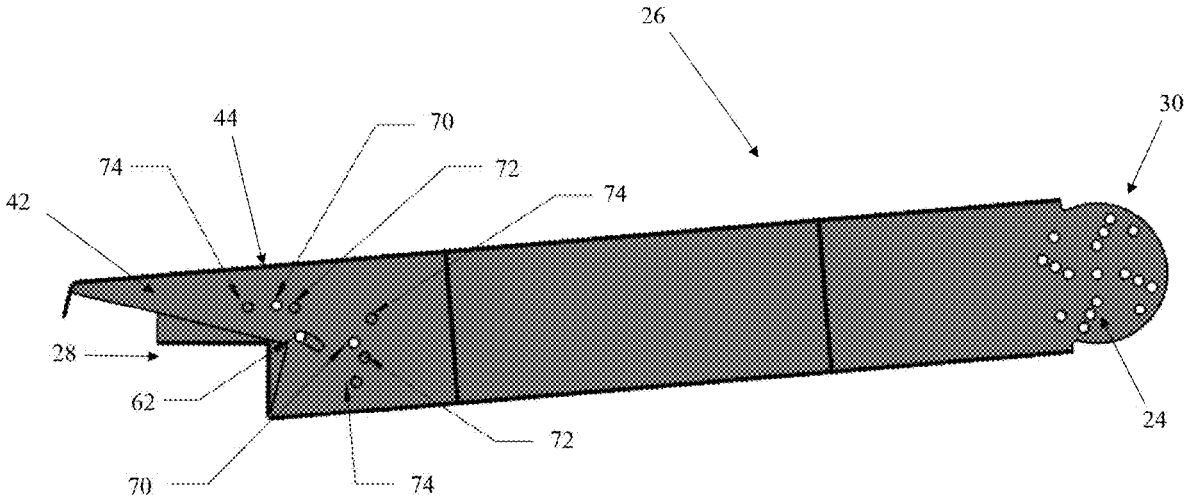
FIG. 7 is a side view of the eave rafter with the eave base plate attached thereto according to one embodiment of the present disclosure.

FIG. 7 shows the pitch adjusting mechanism on the eave base plate 42 according to one embodiment of the present disclosure. As illustrated in FIG. 7, the eave base plate 42 is attached to the first end 28 of the eave rafter 26. Similar to the series of attachment holes 24 on the ends of the rafters, the plurality of attachment holes 44 on the side plate 62 correspond to the varying pitch angles at which the eave rafter 26 may be angularly connected with another rafter. The various attachment holes 44 allow for the angle of the eave rafter 26 to be adjusted based on the desired pitch angle of the overall modular rafter assembly 100. As illustrated in FIG. 7, attachment holes 70 may be used for connecting the eave rafter 26 at an angle of about 4.76 degrees (or a 1/12 pitch), attachment holes 72 may be used for connecting the eave rafter 26 at an angle of about 14.04 degrees (or a 3/12 pitch), and attachment holes 74 may be used for connecting the eave rafter 26 at an angle of about 18.43 degrees (or a 4/12 pitch). The adjustability of the eave base plate 42 also allows for structural elements, such as columns, to attach to the front plate 43 at a 90-degree angle even though the eave rafter 26 is angularly connected to other rafters in the modular rafter assembly 100.

Figure 8A:
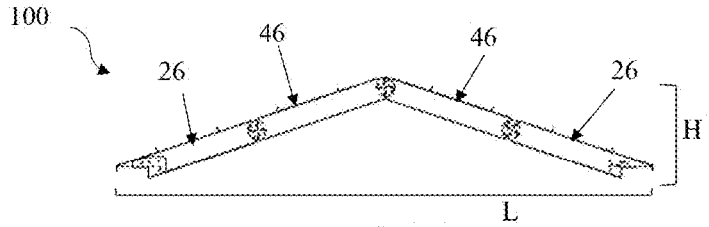
FIG. 8A is a side view of the modular rafter assembly comprised of two extension rafters connected to one another at a 4/12 pitch and two eave rafters connected to each of the extension rafters.
Figure 8B:
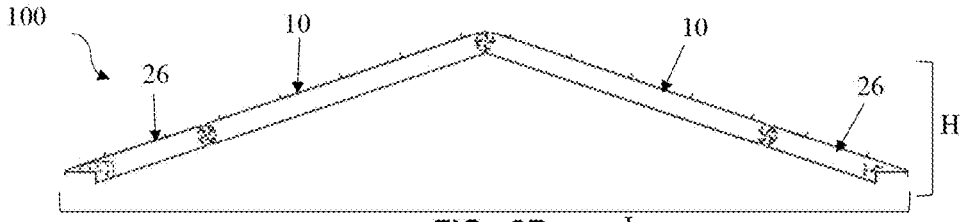
FIG. 8B is a side view of the modular rafter assembly comprised of two main rafters connected to one another at a 4/12 pitch and two eave rafters connected to each of the main rafters.
Figure 8C:
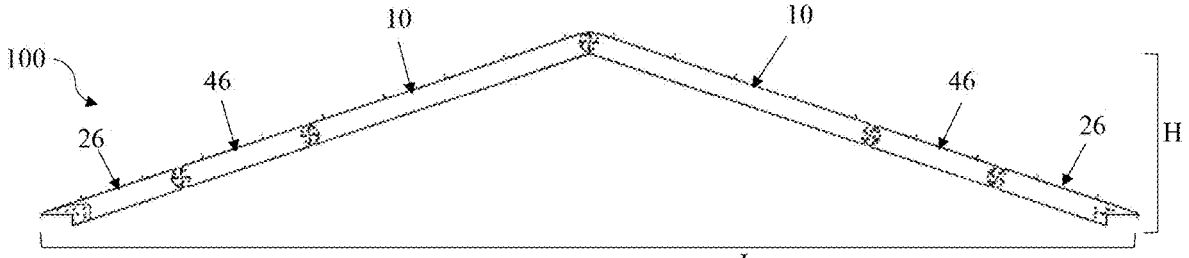
FIG. 8C is a side view of the modular rafter assembly comprised of two main rafters connected to one another at a 4/12 pitch, two extension rafters connected to each of the main rafters, and two eave rafters connected to each of the extension rafters.

FIGS. 8A-8C, 9A-9C, and 10A-10C show various embodiments of the modular roof assembly 100 utilizing combinations of different rafters and having varying pitch angles. FIGS. 8A, 8B, and 8C show embodiments of the modular roof assembly 100 having a 4/12 pitch. The modular roof assembly 100 shown in FIG. 8A includes two extension rafters 46 connected to one another at an angle of about 18.43 degrees (or a 4/12 pitch) and two eave rafters 26 connected to each of the extension rafters 46. In some embodiments, the modular roof assembly 100 shown in FIG. 8A may be particularly suitable for smaller roofs having a 4/12 pitch. In the illustrated embodiment of FIG. 8A, the modular roof assembly 100 has a height H of about 2 feet, 5 inches and a length L of about 14 feet, 10 inches. The modular roof assembly 100 shown in FIG. 8B includes two main rafters 10 connected to one another at an angle of about 18.43 degrees (or a 4/12 pitch) and two eave rafters 26 connected to each of the main rafters 10. In some embodiments, the modular roof assembly 100 shown in FIG. 8B may be particularly suitable for standard size roofs having a 4/12 pitch. For example, in the illustrated embodiment, the modular roof assembly 100 has a height H of about 4 feet, one inch and a length L of about 24 feet, 5 inches. The modular roof assembly 100 shown in FIG. 8C includes two main rafters 10 connected to one another at angle of about 18.43 degrees (or a 4/12 pitch), two extension rafters 46 connected to each of the main rafters 10, and two eave rafters 26 connected to each of the extension rafters 46. In some embodiments, the modular roof assembly 100 shown in FIG. 8C may be particularly suitable for larger roofs having a 4/12 pitch. In the illustrated embodiment of FIG. 8C, the modular roof assembly 100 has a height H of about 5 feet, 5 inches and a length L of about 32 feet, 5 inches.

Figure 9A:
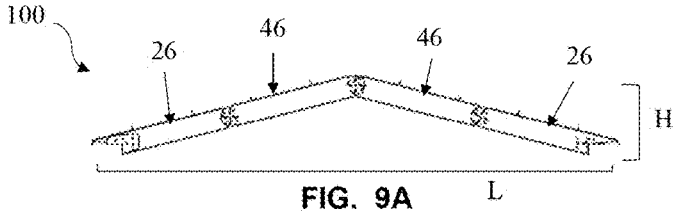
FIG. 9A is a side view of the modular rafter assembly comprised of two extension rafters connected to one another at a 3/12 pitch and two eave rafters connected to each of the extension rafters.
Figure 9B:
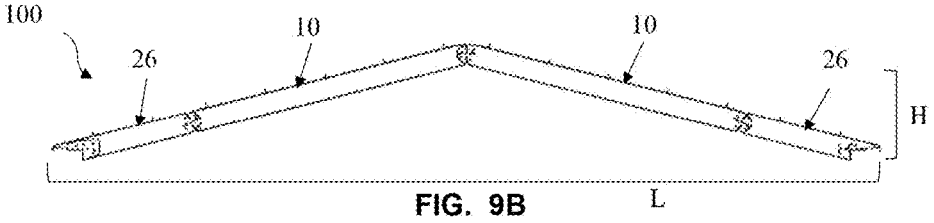
FIG. 9B is a side view of the modular rafter assembly comprised of two main rafters connected to one another at a 3/12 pitch and two eave rafters connected to each of the main rafters.
Figure 9C:
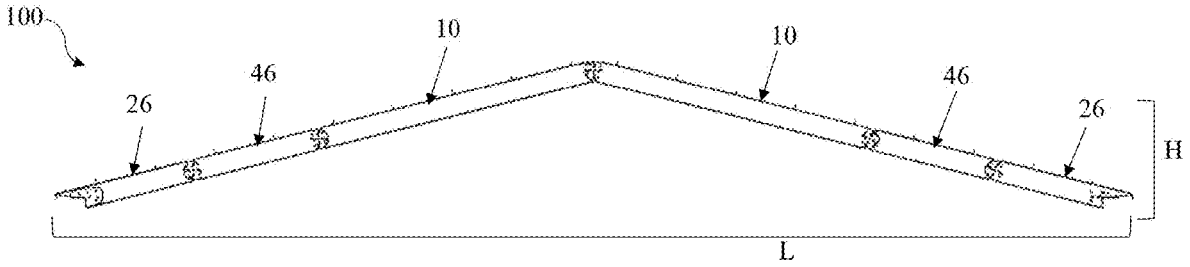
FIG. 9C is a side view of the modular rafter assembly comprised of two main rafters connected to one another at a 3/12 pitch, two extension rafters connected to each of the main rafters, and two eave rafters connected to each of the extension rafters.

FIGS. 9A, 9B, and 9C show embodiments of the modular roof assembly 100 having a 3/12 pitch. The modular roof assembly 100 shown in FIG. 9A includes two extension rafters 46 connected to one another at an angle of about 14.04 degrees (or a 3/12 pitch) and two eave rafters 26 connected to each of the extension rafters 46. In some embodiments, the modular roof assembly 100 shown in FIG. 9A may be particularly suitable for smaller roofs having a 3/12 pitch. In the illustrated embodiment of FIG. 9A, the modular roof assembly 100 has a height H of about 1 foot, 11 inches and a length L of about 15 feet, 3 inches. The modular roof assembly 100 shown in FIG. 9B includes two main rafters 10 connected to one another at an angle of about 14.04 degrees (or a 3/12 pitch) and two eave rafters 26 connected to each of the main rafters 10. In some embodiments, the modular roof assembly 100 shown in FIG. 9B may be particularly suitable for standard size roofs having a 3/12 pitch. For example, in the illustrated embodiment, the modular roof assembly 100 has a height H of about 3 feet, one inch and a length L of about 25 feet, one inch. The modular roof assembly 100 shown in FIG. 9C includes two main rafters 10 connected to one another at angle of about 14.04 degrees (or a 3/12 pitch), two extension rafters 46 connected to each of the main rafters 10, and two eave rafters 26 connected to each of the extension rafters 46. In some embodiments, the modular roof assembly 100 shown in FIG. 9C may be particularly suitable for larger roofs having a 3/12 pitch. In the illustrated embodiment of FIG. 9C, the modular roof assembly 100 has a height H of about 4 feet, 2 inches and a length L of about 33 feet, 3 inches.

Figure 10A:
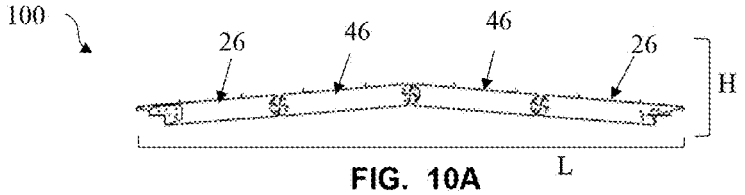
FIG. 10A is a side view of the modular rafter assembly comprised of two extension rafters connected to one another at a 1/12 pitch and two eave rafters connected to each of the extension rafters.
Figure 10B:
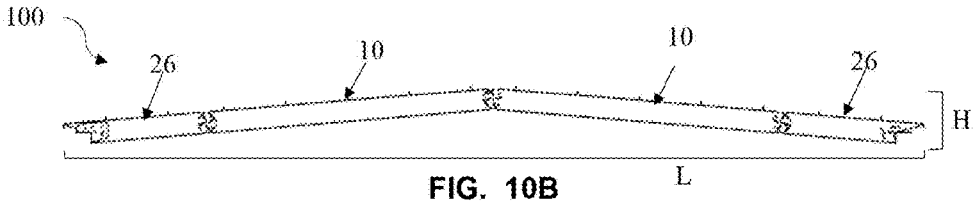
FIG. 10B is a side view of the modular rafter assembly comprised of two main rafters connected to one another at a 1/12 pitch and two eave rafters connected to each of the main rafters.
Figure 10C:
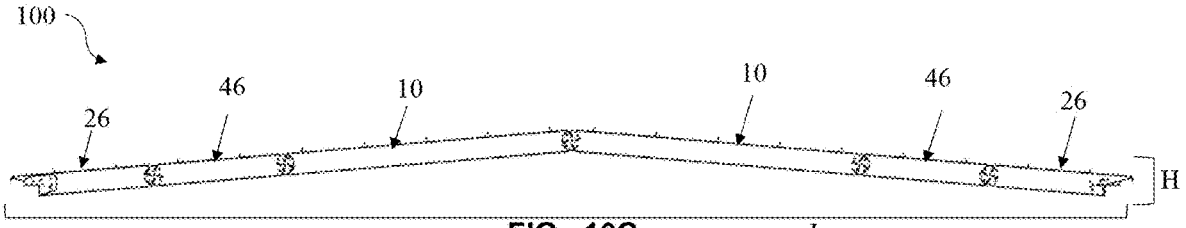
FIG. 10C is a side view of the modular rafter assembly comprised of two main rafters connected to one another at a 1/12 pitch, two extension rafters connected to each of the main rafters, and two eave rafters connected to each of the extension rafters.

FIGS. 10A, 10B, and 10C show embodiments of the modular roof assembly 100 having a 1/12 pitch. The modular roof assembly 100 shown in FIG. 10A includes two extension rafters 46 connected to one another at an angle of about 4.76 degrees (or a 1/12 pitch) and two eave rafters 26 connected to each of the extension rafters 46. In some embodiments, the modular roof assembly 100 shown in FIG. 10A may be particularly suitable for smaller roofs having a 1/12 pitch. In the illustrated embodiment of FIG. 10A, the modular roof assembly 100 has a height H of about 7.75 inches and a length L of about 15 feet, 9 inches. The modular roof assembly 100 shown in FIG. 10B includes two main rafters 10 connected to one another at an angle of about 4.76 degrees (or a 1/12 pitch) and two eave rafters 26 connected to each of the main rafters 10. In some embodiments, the modular roof assembly 100 shown in FIG. 10B may be particularly suitable for standard size roofs having a 1/12 pitch. For example, in the illustrated embodiment, the modular roof assembly 100 has a height H of about 1 foot, one inch and a length L of about 25 feet, 10 inches. The modular roof assembly 100 shown in FIG. 10C includes two main rafters 10 connected to one another at angle of about 4.76 degrees (or a 1/12 pitch), two extension rafters 46 connected to each of the main rafters 10, and two eave rafters 26 connected to each of the extension rafters 46. In some embodiments, the modular roof assembly 100 shown in FIG. 10C may be particularly suitable for larger roofs having a 1/12 pitch. In the illustrated embodiment of FIG. 10C, the modular roof assembly 100 has a height H of about 1 foot, 5 inches and a length L of about 34 feet, 3 inches.

As demonstrated in FIGS. 8A-8C, 9A-9C, and 10A-10C, the modular roof assembly 100 of the present disclosure can be easily adjusted to varying lengths, heights, and pitch angles based on the use of different combinations of rafters and the pitch adjusting mechanism on the rafters. The rafters disclosed herein can be made from a variety of materials including, but not limited, steel alloys, wood, such as pine, cedar, or spruce, or structural composite lumber, such as LVL (laminated veneer lumber). The material thickness for the rafters is determined by load conditions and can vary depending on the desired application.

Figure 11A:
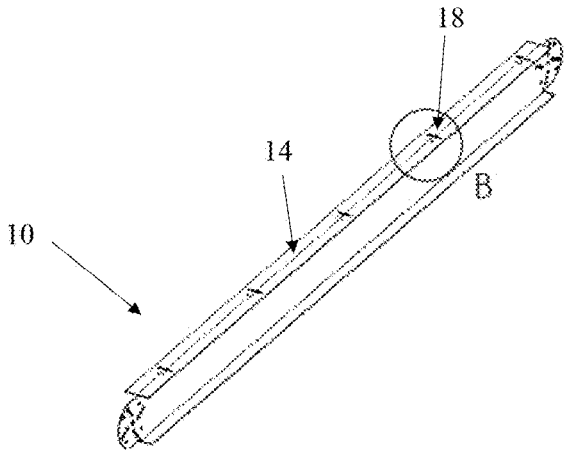
FIG. 11A is a front perspective view of a main rafter showing slots for attachment of purlin clips.
Figure 11B:
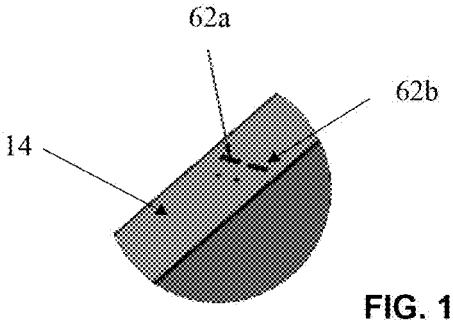
FIG. 11B is a front perspective view of detail B shown in FIG. 11A.

FIGS. 11A and 11B show the slots 18 on the top flanges of the rafters for attaching purlins. In the illustrated embodiment, the main rafter 10 is shown in FIG. 11A with five slots 18 positioned on the top flange 14. As shown in FIG. 11B, each of the slots 18 are comprised of two rectangular holes 63*a*, 63*b* positioned next to one another. The rectangular holes 63*a*, 63*b* are designed to receive tabs on the purlins, as will be described below, to securely attach the purlins to the rafters. While FIG. 11A illustrates the use of five slots, one of ordinary skill in the art will readily appreciate that any number of slots may be used on the rafters as a mechanism for attaching the purlins.

Figure 12:
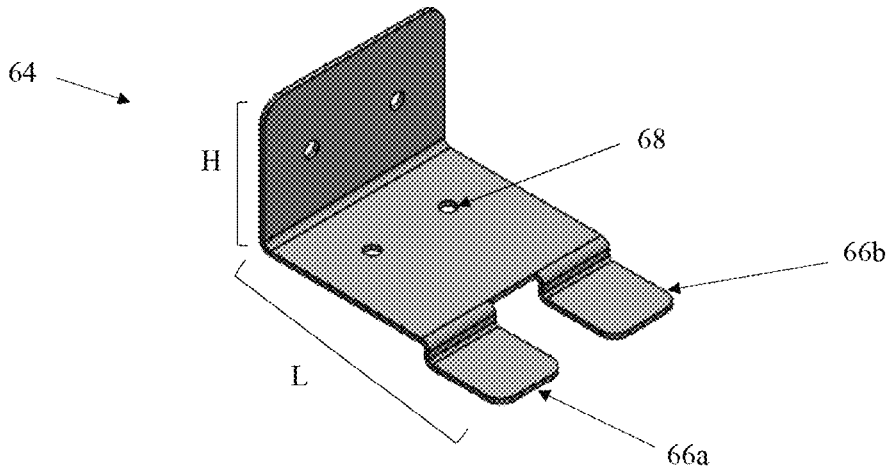
FIG. 12 is a front perspective view of a purlin clip according to an exemplary embodiment of the present disclosure.

FIG. 12 illustrates a purlin clip 64 according to an exemplary embodiment of the present disclosure. As illustrated in FIG. 12, the purlin clip 64 has a generally "L" shaped cross section. The purlin clip 64 includes two tabs 66*a*, 66*b* extending outwardly that are designed for insertion into the two rectangular holes 63*a*, 63*b* of each of the slots 18. The purlin clip 64 may include a plurality of attachment holes 68 for receiving a fastener, such as a screw or bolt, for securely attaching the purlin clip 64 to the rafter. In some embodiments, the purlin clip 64 may be made of metal, such as steel. In other embodiments, the purlin clip 64 may be made of wood. The length of the purlin clips 64 is dependent on the roof load. In other words, the length of the purlins 64 may be increased to increase roof load capabilities. In some embodiments, the purlin clips 64 may have a length L of about 2 inches to about 5 inches. In further embodiments, the purlin clips 64 may have a length L of about 2.5 inches to about 4.5 inches. In still further embodiments, the purlin clips 64 may have a length L of about 3 inches to about 4 inches. For example, the purlin clips 64 may have a length L of about 3.19 inches. The purlin clips 64 may also have a height H of about 1 inch to about 2 inches, preferably about 1.25 inches to about 1.75 inches.

Figure 13A:
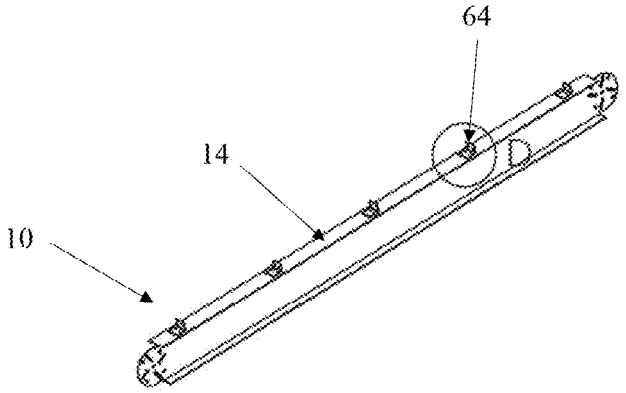
FIG. 13A is a front perspective view of a main rafter having purlin clips attached to the slots according to one embodiment of the present disclosure.
Figure 13B:
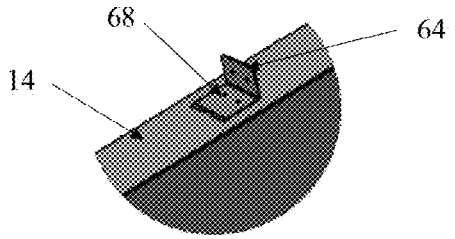
FIG. 13B is a front perspective view of detail D shown in FIG. 13A.

FIGS. 13A and 13B show the purlin clips 64 inserted into the slots 18 and attached to the top flange 14 of the main rafter 10. As illustrated in FIGS. 13A and 13B, the tabs 66*a*, 66*b* on each of the purlin clips 64 are inserted into the rectangular holes 63*a*, 63*b* of each slot 18 such that the purlin clips 64 extend generally perpendicular to the rafter to secure roof sheathing to a building. In the illustrated embodiment, five purlin clips 64 are attached to the top flange 14 of the main rafter 10. Fasteners, such as bolts or screws, may be placed through the plurality of attachment holes 68 on the purlin clips 64 to ensure the purlin clips 64 are securely fastened to the top flange 14.

Figure 14A:
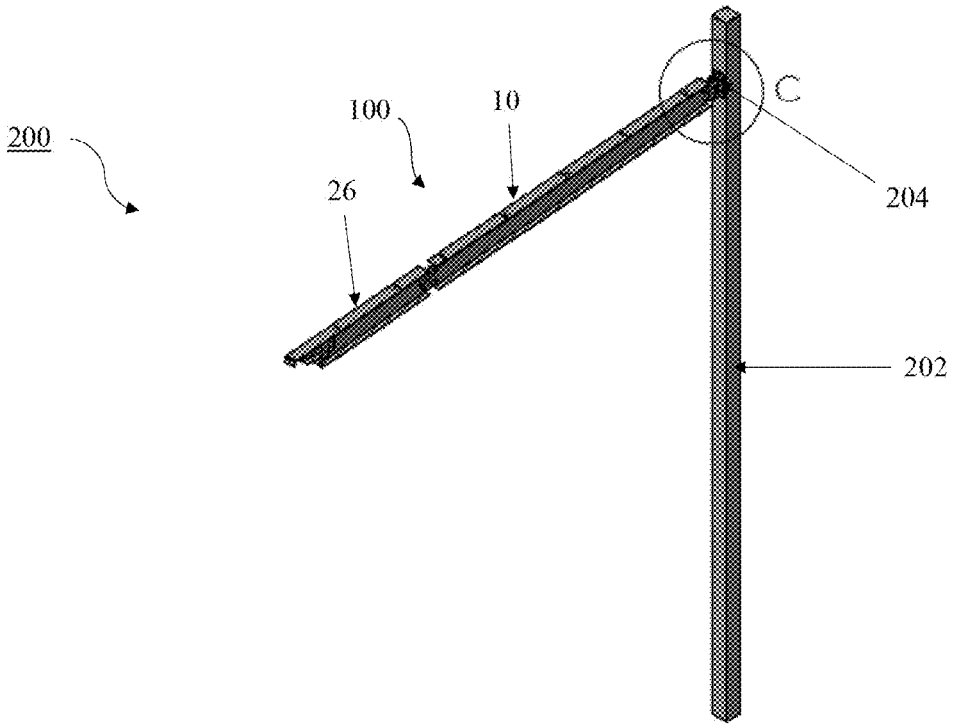
FIG. 14A is a front perspective view of a lean-to structure utilizing a modular rafter assembly according to one embodiment of the present disclosure.

FIG. 14A shows a lean-to structure 200 that can be used with the rafters disclosed herein. The lean-to structure 200 includes a vertical column 202 having a lean-to attachment plate 204 attached thereto. The lean-to attachment plate 204 can be attached to the vertical column 202 using any type of securing mechanism including, but not limited to, bolts, screws, nails, adhesives, or clips. The modular rafter assembly 100 disclosed herein can be operatively attached to the lean-to attachment plate 204 to provide a frame having variable pitch angles for a lean-to roof, which is a style of a pitched roof with a single slope. In the illustrated embodiment of FIG. 14A, the modular rafter assembly 100 attached to the vertical column 202 is comprised of a main rafter 10 connected to an eave rafter 26. However, any of the other combinations of rafters described herein may be used with the lean-to structure 200, for instance, a main rafter 10 connected to an extension rafter 46 and the extension rafter 46 connected to the eave rafter 26 or an extension rafter 46 connected to an eave rafter 26.

Figure 14B:
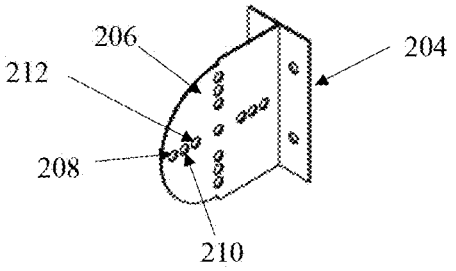
FIG. 14B is a front perspective view of a lean-to attachment plate according to one embodiment of the present disclosure.
Figure 14C:
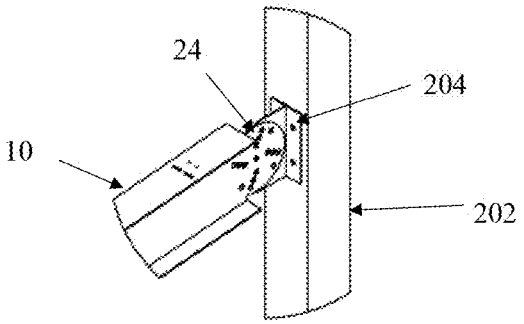
FIG. 14C is a perspective view of detail C shown in FIG. 14A.

FIGS. 14B and 14C show the lean-to attachment plate 204 and the modular rafter assembly 100 attached thereto. As shown in FIG. 14B, the lean-to attachment plate 204 includes a series of attachment holes 206 similar to the attachment holes 24 on the ends of the rafters described herein that can be used to attach the modular rafter assembly 100 at varying pitch angles. The series of attachment holes 206 include four sections of three linear attachment holes that match the series of attachment holes 24 on the ends of the rafters. The attachment holes on the lean-to attachment plate 204 correspond to the varying pitch angles at which the modular rafter assembly 100 may be angularly connected to the lean-to structure 200. Like the linear attachment holes on the ends of the rafters, the three linear attachment holes on the lean-to attachment plate 204 include an outermost hole 208 for connecting the modular rafter assembly 100 at an angle of about 18.43 degrees (or a 4/12 pitch), a middle hole 210 for connecting the modular rafter assembly 100 at an angle of about 14.04 degrees (or a 3/12 pitch), and an innermost hole 212 for connecting the modular rafter assembly 100 at an angle of about 4.76 degrees (or a 1/12 pitch). As illustrated in FIG. 14C, the different attachment holes, i.e., the outermost hole 208, the middle hole 210, and the innermost hole 212, allow for the modular rafter assembly 100 to be attached at various angles, which in turn, allows for the framing and construction of lean-to roofs having variable pitch angles. A fastener (not shown), such as a bolt or screw, may be placed through the outermost hole 52, the middle hole 54, or the innermost hole 56 on the rafter and a corresponding outermost hole 208, middle hole 210, or innermost hole 212 on the lean-to attachment plate 204 to connect the rafter and secure the rafter to the lean-to attachment plate 204 at the desired pitch angle.

Figure 15:
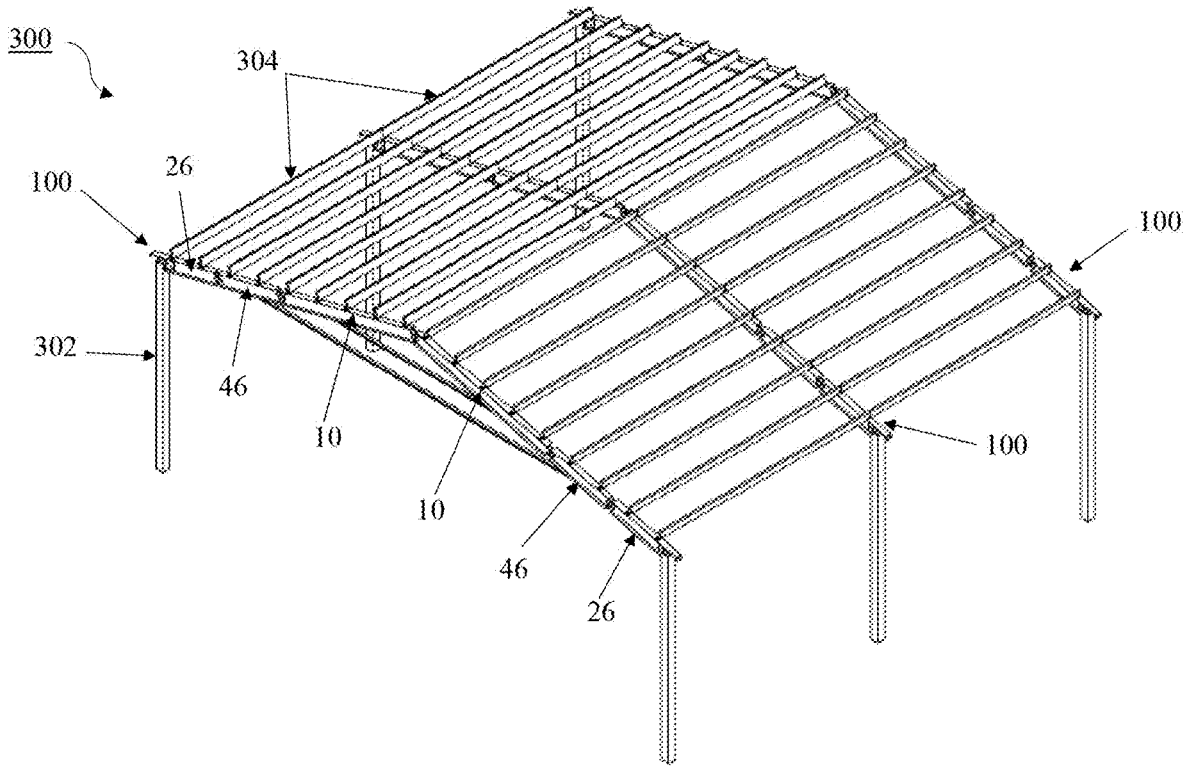
FIG. 15 is a front perspective view of a building structure utilizing the modular rafter assembly according to one embodiment of the present disclosure.

FIG. 15 shows a building structure 300 utilizing the modular rafter assembly 100 of the present disclosure. As illustrated in FIG. 15, the building structure 300 utilizes three modular rafter assemblies 100, each comprised of two main rafters 10 connected to one another at an angle of about 14.04 degrees (or a 3/12 pitch), two extension rafters 46 connected to each of the main rafters 10, and two eave rafters 26 connected to each of the extension rafters 46. A plurality of support columns 302 are operatively attached to each of the eave base plates 42 on the end of the eave rafters 26. The support columns 302 are generally rectangular in shape; however, the support columns 302 may also be square or tubular. The purlin clips 64 may be attached along the top flanges of the rafters for connecting a plurality of purlin members 304 perpendicularly to the modular rafter assemblies 100. An exterior sheathing or roof shingles (not shown) may be mounted on top of the purlin members 304 to form a roof.

The rafter assemblies described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the rafter assemblies in addition to those shown and described herein will become apparent to those skilled in the art from the foregoing description. For example, while the present disclosure describes modular rafter assemblies, other roofing members, such as trusses, may incorporate the pitch adjusting mechanisms described herein as well as the modular design described herein. Such modifications are also intended to fall within the scope of the disclosure. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the invention(s) set forth herein.

What is claimed is:

1. A modular rafter assembly having an adjustable pitch angle, comprising:

a first pair of angularly disposed rafters, each rafter comprising a plurality of linear attachment holes, wherein the plurality of linear attachment holes each correspond to a different pitch angle, and wherein the first pair of angularly disposed rafters are adjustably connected at an attachment hole to secure the rafters to a structural element at a desired pitch angle, and a pair of eave rafters, each eave rafter operatively connected to one of the angularly disposed rafters, and wherein each eave rafter comprises a base plate defined by a side plate and an L-shaped front plate configured to adjust the eave rafter to the pitch angle of the angularly disposed rafters.

2. The modular rafter assembly of claim 1, wherein each side plate comprises a plurality of attachment holes for adjusting the eave rafter to the pitch angle of the angularly disposed rafters.

3. The modular rafter assembly of claim 1, wherein each front plate comprises an attachment hole for connecting a support member thereto.

4. The modular rafter assembly of claim 1, wherein each of the angularly disposed rafters and the eave rafters comprises a top flange having a slot configured for attachment of a purlin clip.

5. The modular rafter assembly of claim 1, wherein each of the angularly disposed rafters and the eave rafters comprises a top flange and a bottom flange forming two open sides.

6. The modular rafter assembly of claim 1, further comprising a second pair of angularly disposed rafters operatively connected to the first pair of angularly disposed rafters and the eave rafters, wherein the second pair of angularly disposed rafters are shorter than the first pair of angularly disposed rafters.

7. The modular rafter assembly of claim 1, wherein the plurality of linear attachment holes comprises four sections of three linear attachment holes.

8. The modular rafter assembly of claim 7, wherein the three linear attachment holes comprise an outermost hole corresponding to a 4/12 pitch angle, a middle hole corresponding to a 3/12 pitch angle, and an innermost hole corresponding to a 1/12 pitch angle.

9. A building structure, comprising:

a pair of modular rafter assemblies, each modular rafter assembly comprising:

a pair of angularly disposed rafters, each rafter comprising a plurality of linear attachment holes, wherein the plurality of linear attachment holes each correspond to a different pitch angle, and wherein the pair of angularly disposed rafters are adjustably connected at an attachment hole to secure the rafters to a structural element at a desired pitch angle, a pair of eave rafters, each eave rafter operatively connected to one of the angularly disposed rafters, and wherein each eave rafter comprises a base plate defined by a side plate and an L-shaped front plate configured to adjust the eave rafter to the pitch angle of the angularly disposed rafters, a plurality of support members operatively attached to each eave rafter, and a plurality of purlin members attached to each modular rafter assembly and extending laterally therebetween.

10. The building structure of claim 9, further comprising a plurality of purlin clips attached to each modular rafter assembly and configured for supporting the plurality of purlin members.

11. The building structure of claim 9, wherein the plurality of linear attachment holes comprises a first hole corresponding to a 4/12 pitch angle, a second hole corresponding to a 3/12 pitch angle, and a third hole corresponding to a 1/12 pitch angle.

12. The building structure of claim 9, further comprising an exterior sheathing mounted on the plurality of purlin members.

* * * * *